United States Patent [19]

Sommer

[11] Patent Number: 4,581,256

[45] Date of Patent: Apr. 8, 1986

[54] ELECTROLESS PLATING COMPOSITION AND METHOD OF USE

[75] Inventor: Walter R. Sommer, Ridgewood, N.Y.

[73] Assignee: Chemline Industries, Carson City, Nev.

[21] Appl. No.: 673,232

[22] Filed: Nov. 19, 1984

[51] Int. Cl.[4] ..... B05D 3/04; B05D 3/10

[52] U.S. Cl. ..... 427/305; 106/1.26; 106/1.27; 427/306

[58] Field of Search ..... 427/305, 306; 106/1.26, 106/1.27

[56] References Cited

U.S. PATENT DOCUMENTS

| | | | |
|---|---|---|---|
| 3,992,211 | 11/1976 | Skill | 106/1 |
| 4,131,699 | 12/1978 | Feldstein | 427/306 |
| 4,132,832 | 1/1979 | Feldstein | 428/462 |
| 4,136,216 | 1/1979 | Feldstein | 427/306 |
| 4,167,596 | 9/1979 | Feldstein | 427/306 |
| 4,180,600 | 12/1979 | Feldstein | 427/97 |
| 4,253,875 | 3/1981 | Heymann et al. | 106/1.26 |
| 4,259,376 | 3/1981 | Feldstein | 427/304 |
| 4,261,747 | 4/1981 | Feldstein | 106/1.11 |
| 4,265,942 | 5/1981 | Feldstein | 427/304 |
| 4,273,804 | 6/1981 | Feldstein | 427/97 |
| 4,282,271 | 8/1981 | Feldstein | 427/98 |
| 4,293,591 | 10/1981 | Feldstein | 427/97 |

*Primary Examiner*—James R. Hoffman

*Attorney, Agent, or Firm*—Townsend and Townsend

[57] ABSTRACT

The stability of alkaline electroless plating baths and the rate at which such baths are capable of depositing a metal film on a nonconductor substrate are both enhanced by the incorporation of a water soluble saccharide derivative into the bath composition. The saccharide derivatives include monosaccharides, oligosaccharides, polysaccharides, and saccharide reaction products such as gluconic and glucoheptonic acids and salts thereof.

21 Claims, No Drawings

ELECTROLESS PLATING COMPOSITION AND METHOD OF USE

BACKGROUND OF THE INVENTION

This invention relates to electroless plating of metals on nonconductor substrates, and in particular to the stability of plating baths and the rate at which they cause plating to occur.

The plating of dielectric substrates by nonelectrical means has a wide range of application, including both decorative and utilitarian purposes. It is of particular utility in the printed circuit board industry, where it is one of the most important steps in the multistep process of the formation of signal trace patterns.

Two of the problems often encountered in electroless metal deposition processes are the dropping out of metal from the plating solution during storage (i.e., spontaneous reduction to the metallic form) and slow deposition rates when in contact with the substrate to be plated. Considering the high cost of the electroless plating baths, it is clear that these problems are detrimental to the industry in the economic sense.

SUMMARY OF THE INVENTION

It has now been discovered that alkaline electroless plating baths are considerably improved in terms of both storage stability and deposition rate on a nonconductor substrate by the addition of a water soluble saccharide derivative. Adding but a small amount of the additive to the plating bath provides both an unusually increased storage stability, substantially inhibiting spontaneous uncatalyzed plating-out of the metal from the bath, and a substantial increase in the rate at which metal deposition occurs on an appropriately catalyzed substrate.

DESCRIPTION OF THE PREFERRED EMBODIMENTS

The saccharide-derived additives to which the newly discovered results are attributed include a wide range of saccharides, acids, salts and carbohydrates, including monosaccharides, oligosaccharides, polysaccharides, and reaction products derived by hydrolysis, oxidation, or other reactions thereof, including ring-opening reactions.

Examples of monosaccharides within the contemplation of the present invention are glucose, fructose, and galactose. Examples of oligosaccharides are sucrose, lactose, maltose, stachyose, maltopentaose, and cyclomaltohexaose. Illustrative polysaccharides include such materials as pectates, alginates, and carrageenans. The latter include naturally occurring substances such as plant exudates, examples of which are algin, carrageenan, acacia and ghatti gum. Preferred polysaccharides are those having a molecular weight of at least about 10,000, preferably from about 100,000 to about 1,000,000.

Examples of saccharide reaction products include gluconic acid, glucoheptonic acids and salts thereof.

The additive may be a single species or a combination of species. The amount used is not critical, beneficial results being attainable over a wide concentration range. In general, the concentration may be any concentration which will enhance the rate of deposition. Indeed, the discovery of the present invention is unusual in that the saccharide-derived species is effective at very low concentrations. In preferred embodiments of the invention, the species is used at a concentration ranging from about 0.1 to about 20, preferably from about 0.1 to about 10 grams of additive per liter of total plating solution.

Similarly, the pH is not critical and may vary widely within the alkaline range. In preferred embodiments, the pH ranges from about 8 to about 14, a pH of about 11 to about 13 being particularly preferred for copper deposition.

The composition and method of the present invention are applicable to electroless metal plating in general as applied to nonconductor substrates. Although such substrates cover a wide range of materials, the most common examples are those materials commonly used in the manufacture of printed circuit boards. These include porcelain, ceramics, paper, cloth, glass, epoxies, polyimides, polyamides, and various combinations and laminates of such materials. Materials such as epoxy resins and Fiberglas® are the most common.

The invention is applicable to plating metals in general, notably nickel and copper, with copper plating being the preferred application of the invention. The plating bath itself may be any conventional chemical metal plating bath, of which a wide variety are known. The general composition of such a bath includes a salt of the metal to be plated, a complexer or combination of complexers, a buffer, a reducing agent, and optionally one or more additives to control the properties of the deposited film and the rate of deposition. In the case of copper plating, preferred salts are chloride, sulfate, and nitrate, and a preferred reducing agent is formaldehyde.

The process of electroless deposition may be performed according to conventional techniques. In general, the deposition step is preceded by catalyzation or "sensitization" of the surface. This is generally done by depositing a small amount of a precious metal on the surface of the substrate by exposing the substrate to an aqueous solution or suspension of a halide of the metal together with a reducing agent. The most commonly used precious metal halides include platinum, palladium and rhodium chlorides, while common reducing agents include stannous, titanium and lead chlorides. The copper or nickel deposition is then achieved by immersing the sensitized substrate in the plating bath for a predetermined length of time. The concentrations of the bath components and the length of time the substrate is immersed are not critical provided that a substantially uniform layer of the desired thickness is achieved. The selection of optimum conditions will be readily apparent to those skilled in the art.

In most applications of the invention, a number of preconditioning and intermediate steps are also included as part of the overall procedure. For example, an aqueous alkaline detergent solution at an elevated temperature is generally used for the first treatment of the substrate, to remove grease and light soils from the surface and render it smooth and porous. A light etchant is then normally applied for improving the adhesion properties of the surface. A variety of reagents are known to be useful for this purpose, notably peroxides, persulfates, chromates, cupric chloride and sulfuric acid, depending on the nature of the surface to be etched. Finally, a wetting agent can be applied to render the surface more receptive to aqueous films. Anionic or nonionic surfactants are generally used, including alkylarylpolyethers, long chain alcohols, fluorocarbons, etc. A thorough water rinse is applied between each of these pre-conditioning steps to remove excess solution from the surface. In addition, an accelerator solution may be applied after the sensitization step, the accelerator generally comprising a mild acid or alkali, acids being preferred, notably sulfuric, perchloric, hydrochloric and fluoboric acids. Again, thorough water rinses are used between each treatment to preserve the integrity and activity of each of the treatment baths.

The following examples are offered for illustrative purposes and are intended neither to define nor limit the invention in any manner.

EXAMPLE 1

An electroless copper bath was prepared by dissolving the following ingredients in water:

| | |
|---|---|
| Cupric chloride, dihydrate | 13.25 g/l |
| Quadrol* | 25.00 g/l |
| Sodium hydroxide | 17.10 g/l |
| Sodium cyanide | 7.80 mg/l |
| 2,2'-Dipyridyl | 6.00 mg/l |
| 37% Formaldehyde | 16.00 ml/l |

*1,1',1'',1'''-(ethylenedinitrilo)tetra-2-propanol

In addition to this control bath, two further baths were prepared, each identical to the control bath except for the further addition of a saccharide-derived additive. The additive in the first was sodium alginate at 0.5 g/liter, while that in the second bath was sodium alpha-glucoheptonate at 0.5 g/liter.

The substrates used were an epoxy reinforced, Fiberglas laminate. Prior to immersion in the plating bath, the substrates were cleaned in an alkaline detergent solution at 160° F. (71° C.) (the product used was ADCLEAN 6A, a product of Chemline Industries, Carson City, Nev.), rinsed in running water, etched in a sulfuric acid/hydrogen peroxide solution at 110° F. (43° C.) (PEROXY ETCH 63, Chemline Industries), rinsed again, treated with a pre-dip solution of hydrochloric acid (to protect the reducing agent used in conjunction with the precious metal salt in the next step from premature oxidation), sensitized with a palladium chloride-stannous chloride-hydrochloric acid solution at 100° F. (38° C.), rinsed again, immersed in a fluoboric acid accelerator solution, and rinsed again. The substrates were then placed in the electroless plating baths at 25° C. and a workload of 0.5 $ft^2$/gallon (0.013 $m^2$/liter) for thirty minutes with agitation provided by a magnetic stirring bar.

The plated laminates were then rinsed and etched and the copper titrated with 0.1N ethylenediaminetetraacetic acid to determine the plating thickness. The depleted baths were also let stand overnight in glass beakers at ambient temperature to determine the stability of the solutions.

The plating results were as follows:

TABLE 1

PLATING THICKNESS

| Additive | Plating Thickness at 30 Minutes |
|---|---|
| None (control) | 52.6 microinches |
| Sodium Alginate-0.5 g/l | 64.5 microinches |
| Sodium Alpha-Glucoheptonate-0.5 g/l | 60.7 microinches |

The stability test resulted in copper plating out in the glass beaker from the control bath. No such plating out could be detected in either of the other two baths.

EXAMPLE 2

Three electroless copper baths were prepared, using the same composition as the control bath of Example 1, plus the following additives:

Bath 1: Sodium alginate, 0.5 g/l
Bath 2: Acacia, 2.0 g/l
Bath 3: Sodium alginate, 0.5 g/l, and Acacia, 0.5 g/l Substrates as described in Example 1 were conditioned and plated with these baths in the manner described in Example 1, except for fifteen minutes rather than thirty. The results were as follows:

TABLE 2

PLATING THICKNESS

| Additive | Plating Thickness at 15 Minutes |
|---|---|
| Sodium alginate-0.5 g/l | 30.4 microinches |
| Acacia-2.0 g/l | 66.7 microinches |
| Sodium alginate-0.5 g/l; and Acacia-0.5 g/l | 47.7 microinches |

The baths were let stand overnight, and no plating out of copper could be detected.

EXAMPLE 3

Four electroless copper baths were prepared, using the same composition as the control bath of Example 1, plus the following additives:

Bath 1: Sodium Alginate, 0.5 g/l
Bath 2: Pectin, 0.5 g/l
Bath 3: Sodium alpha-glucoheptonate, 0.5 g/l
Bath 4: Gelatin, 0.5 g/l Substrates as described in Example 1 were conditioned and plated with these baths in the manner described in Example 1. The results were as follows:

TABLE 3

PLATING EFFICIENCY

| Additive | Plating Thickness | Color |
|---|---|---|
| Na alginate-0.5 g/l | 32.5 microinches | Bright pink |
| Pectin-0.5 g/l | 41.2 microinches | Red |
| Na alpha-glucoheptonate-0.5 g/l | 37.9 microinches | Bright pink |
| Gelatin-0.5 g/l | 54.2 microinches | Dark, streaky |

Stability tests showed plating out of copper in the baths containing pectin and gelatin, and no plating out in the remaining two baths.

The foregoing description is intended solely for purposes of illustration. The invention is not intended to be limited to the particular features described. Numerous modifications and variations from the above still falling within the spirit and scope of the invention will be readily apparent to those skilled in the art.

What is claimed is:

1. An alkaline electroless metal plating solution comprising, in aqueous solution, a water soluble metal salt, a reducing agent sufficient to cause reduction of said metal salt to metallic form, a complexing agent sufficient to control the rate of reduction of said metal salt, and a water soluble saccharide derivative at a concentration of about 0.1 to about 20 grams per liter of said solution.

2. A plating solution in accordance with claim 1 in which said saccharide derivative is a polysaccharide having a molecular weight of at least about 10,000.

3. A plating solution in accordance with claim 1 in which said saccharide derivative is a plant exudate.

4. A plating solution in accordance with claim 1 in which said saccharide derivative is a member selected from the group consisting of algin, carrageenan, acacia, ghatti gum and sodium glucoheptonate.

5. A plating solution in accordance with claim 1 in which said saccharide derivative is a polysaccharide having a molecular weight of about 100,000 to about 1,000,000.

6. A plating solution in accordance with claim 1 in which the concentration of said saccharide derivative is from about 0.1 to about 10 grams per liter of said solution.

7. A plating solution in accordance with claim 1 in which said metal salt is a copper salt.

8. A plating solution in accordance with claim 1 in which said metal is copper and the anion of said salt is a member selected from the group consisting of chloride, sulfate and nitrate.

9. A plating solution in accordance with claim 1 in which the pH of said solution is from about 8 to about 14.

10. An alkaline electroless copper plating solution comprising, in aqueous solution:

(a) a water soluble copper salt selected from the group consisting of cupric chloride, copper sulfate and copper nitrate;

(b) a reducing agent sufficient to cause reduction of said copper salt to metallic copper;

(c) a complexing agent sufficient to control the rate of reduction of said copper salt;

(d) a base sufficient to render the pH of said solution from 11 to about 13; and (e) at least one water soluble saccharide derivative selected from the group consisting of algin, acacia, carrageenan, ghatti gum and sodium glucoheptonate, at a total concentration of from about 0.1 to about 10 grams of saccharide derivative per liter of said solution.

11. A plating solution in accordance with claim 10 in which said water soluble saccharide derivative is selected from the group consisting of algin and acacia.

12. A process for the electroless metal plating of a nonconductor, said process comprising:

(a) treating said nonconductor with an agent catalytic for electroless metal deposition; and (b) contacting said treated nonconductor with an alkaline aqueous solution comprising a water soluble metal salt, a reducing agent sufficient to reduce said metal to metallic form, a complexing agent sufficient to control the rate of reduction of said metal, and a water soluble saccharide derivative at a concentration of about 0.1 to about 20 grams per liter of said solution, to deposit thereon a layer of said metal in metallic form.

13. A process in accordance with claim 12 in which the concentration of said saccharide derivative is from about 0.1 to about 10 grams per liter of said alkaline aqueous solution.

14. A process in accordance with claim 12 in which said metal salt is a member selected from the group consisting of copper chloride, copper sulfate and copper nitrate.

15. A process in accordance with claim 12 in which said catalytic agent is comprised of an aqueous solution of a precious metal halide and reducing agent therefor.

16. A process in accordance with claim 12 in which said catalytic agent is comprised of an aqueous solution of palladium chloride and stannous chloride, and said metal salt is cupric chloride.

17. A process in accordance with claim 12 in which the pH of the alkaline aqueous solution of step (b) is from about 8 to about 14.

18. A process in accordance with claim 12 in which said metal salt is a copper salt and the pH of the alkaline solution in step (b) is from about 11 to about 13.

19. A process in accordance with claim 12 in which said metal salt is a copper salt and said saccharide derivative is a polysaccharide having a molecular weight of at least about 10,000.

20. A process in accordance with claim 12 in which said metal salt is a copper salt and said saccharide derivative is a member selected from the group consisting of algin, carrageenan, acacia, ghatti gum, and sodium glucoheptonate.

21. A process for the electroless copper plating of a nonconductor, said process comprising:

(a) contacting said nonconductor with an aqueous solution of palladium chloride and stannous chloride to sensitize the surface of said nonconductor for electroless copper deposition; and (b) contacting said sensitized nonconductor surface with an aqueous solution having a pH of from about 11 to about 13, said solution comprising cupric chloride, a reducing agent sufficient to reduce said cupric ion to copper metal, a complexing agent sufficient to control the rate of reduction of said ion, and at least one water soluble saccharide derivative selected from the group consisting of algin, acacia, and sodium glucoheptonate, at a total saccharide derivative concentration of from about 0.1 to about 10 grams per liter of said solution.

* * * * *